US009056499B2

(12) United States Patent
Kajino et al.

(10) Patent No.: US 9,056,499 B2
(45) Date of Patent: Jun. 16, 2015

(54) IMAGE RECORDING APPARATUS

(75) Inventors: Itsuki Kajino, Kyoto (JP); Masayuki Kataoka, Kyoto (JP)

(73) Assignee: SCREEN HOLDINGS CO., LTD., Kyoto (JP)

( * ) Notice: Subject to any disclaimer, the term of this patent is extended or adjusted under 35 U.S.C. 154(b) by 371 days.

(21) Appl. No.: 13/302,337

(22) Filed: Nov. 22, 2011

(65) Prior Publication Data

US 2012/0154500 A1 Jun. 21, 2012

(30) Foreign Application Priority Data

Dec. 17, 2010 (JP) ..... 2010-282252

(51) Int. Cl.

| | |
|---|---|
| ***B41J 2/155*** | (2006.01) |
| ***B41J 2/165*** | (2006.01) |
| ***B41J 2/145*** | (2006.01) |
| ***B41J 11/06*** | (2006.01) |
| ***B41J 11/14*** | (2006.01) |
| ***B41J 11/00*** | (2006.01) |
| ***B41J 2/14*** | (2006.01) |

(52) U.S. Cl.

CPC ..... *B41J 11/0085* (2013.01); *B41J 2/155* (2013.01); *B41J 2/145* (2013.01); *B41J 2/1433* (2013.01); *B41J 2/16585* (2013.01); *B41J 11/14* (2013.01); *B41J 11/06* (2013.01)

(58) Field of Classification Search

CPC ..... B41J 2/15; B41J 2/145; B41J 2/14; B41J 2/16; B41J 2/01; B41J 11/0085; B41J 11/06; B41J 2/155

USPC ..... 347/40, 49, 104

See application file for complete search history.

(56) References Cited

U.S. PATENT DOCUMENTS 4,520,369 A * 5/1985 Shackleton ..... 347/85
6,019,460 A * 2/2000 Ushiogi et al. ..... 347/85

(Continued)

FOREIGN PATENT DOCUMENTS

EP 2123460 A2 11/2009
EP 2241444 A1 10/2010

(Continued)

OTHER PUBLICATIONS

Extended European Search Report issued in European Application No. 11189863.1 dated Jan. 7, 2013.
Japanese Office Action issued in Japanese Application No. 2010-282252 dated Feb. 4, 2014. w/Partial English translation.

*Primary Examiner* — Justin Seo
*Assistant Examiner* — Kendrick Liu
(74) *Attorney, Agent, or Firm* — McDermott Will & Emery LLP

(57) ABSTRACT

A plurality of through holes are provided between upstream ejection ports and downstream ejection ports. Thereby, when a rear end portion and therearound of a paper sheet is opposed to the downstream ejection ports, gas sucked to suction holes exposed at an upstream side of the paper sheet can be absorbed from the through holes. This can suppress an airflow occurring between a housing and the paper sheet. As a result, deviation of ink droplets ejected from the downstream ejection ports can be suppressed.

8 Claims, 6 Drawing Sheets

(56) References Cited

U.S. PATENT DOCUMENTS

| | | | | |
|---|---|---|---|---|
| 2002/0067403 | A1* | 6/2002 | Smith | 347/104 |
| 2005/0122372 | A1* | 6/2005 | Shimizu | 347/22 |
| 2009/0244247 | A1* | 10/2009 | Yamamoto et al. | 347/104 |
| 2009/0284575 | A1* | 11/2009 | Verhoest et al. | 347/104 |
| 2010/0207987 | A1* | 8/2010 | Sano | 347/15 |
| 2010/0231676 | A1* | 9/2010 | Miyagi | 347/104 |
| 2012/0050398 | A1* | 3/2012 | Yamagishi et al. | 347/30 |

FOREIGN PATENT DOCUMENTS

| | | | |
|---|---|---|---|
| JP | 2007-090835 | A | 4/2007 |
| JP | 2009-285871 | | 12/2009 |
| JP | 2009-285871 | A | 12/2009 |
| JP | 2010-089425 | A | 4/2010 |

* cited by examiner

IMAGE RECORDING APPARATUS

BACKGROUND OF THE INVENTION

1. Field of the Invention

The present invention relates to an image recording apparatus that ejects ink droplets to a sheet-shaped recording medium to thereby record an image.

2. Description of the Background Art

Conventionally known is an ink-jet type image recording apparatus that ejects ink droplets to a paper sheet while conveying the paper sheet being held on a holding plate. In this type of image recording apparatus, a plurality of suction holes are formed in the holding plate. The paper sheet is sucked to and held on an upper surface of the holding plate due to negative pressure caused by these suction holes. A head unit for ejecting ink droplets is arranged above a paper-sheet conveying path. The image recording apparatus ejects ink droplets from the head unit while conveying the paper sheet together with the holding plate, to thereby record an image on an upper surface of the paper sheet.

The conventional ink-jet type image recording apparatus is disclosed in, for example, Japanese Patent Application Laid-Open No. 2009-285871.

In the above-described image recording apparatus, if a paper sheet placed on the holding plate has a size smaller than a region where the plurality of suction holes are distributed, the suction holes are partially exposed around the paper sheet. When the boundary between the exposed suction hole and the paper sheet passes under the head unit, gas sucked to the exposed suction hole causes an airflow toward the suction hole side to occur between the paper sheet and the head unit. This airflow deviates the ink droplet ejected from the head unit, which may cause a defect such as unevenness.

Particularly in a case where the head unit is shaped into a housing so that a lower surface of the head unit is opposed to an upper surface of the holding plate, the above-mentioned airflow is more likely to occur in a gap space between the head unit and the paper sheet. Sometimes, the head unit includes a plurality of ejection ports arranged in different positions with respect to a conveyance direction. Such a head unit is longer in the conveyance direction, and therefore the above-mentioned airflow is still more likely to occur.

SUMMARY OF THE INVENTION

The present invention is directed to an image recording apparatus. In one aspect of the present invention, an image recording apparatus includes: a holding part having a holding surface for sucking and holding a sheet-shaped recording medium by negative pressure; an ejection part for ejecting an ink droplet to the recording medium held on the holding surface; and a moving part for moving the holding part relative to the ejection part, in a first direction extending along the holding surface. The ejection part includes: a housing having an opposing surface opposed to the holding surface; an upstream ejection port and a downstream ejection port provided on the opposing surface and arranged at an interval in the first direction; and a central bypass passage opened in a region of the opposing surface between the upstream ejection port and the downstream ejection port.

When the recording medium is opposed to only one of the upstream ejection port and the downstream ejection port, gas sucked to suction holes exposed around the recording medium can be absorbed from the central bypass passage. This can suppress an airflow occurring between the ejection part and the recording medium. As a result, deviation of ink droplets in the vicinity of an end portion of the recording medium can be suppressed.

Preferably, the holding part includes a fixture for fixing one end portion of the recording medium to one end portion of the holding part with respect to the first direction.

Preferably, a passage resistance of the central bypass passage is smaller than a passage resistance of a space formed between the recording medium held on the holding part and a part of the opposing surface at a side close to the fixture relative to the central bypass passage.

Absorption of gas from the central bypass passage is more facilitated as compared with occurrence of an airflow between the ejection part and the recording medium. Therefore, the airflow occurring between the ejection part and the recording medium can be further suppressed.

Preferably, an opening area of the central bypass passage is larger than an opening area of a space formed between the recording medium held on the holding part and a part of the opposing surface at a side close to the fixture relative to the central bypass passage.

Absorption of gas from the central bypass passage is more facilitated as compared with occurrence of an airflow between the ejection part and the recording medium. Therefore, the airflow occurring between the ejection part and the recording medium can be further suppressed.

Preferably, the central bypass passage is arranged at a side close to the fixture relative to the center of a region between the upstream ejection port and the downstream ejection port.

This reduces a distance between the ejection port at the side close to the fixture and the central bypass passage. As a result, an airflow occurring between the ejection port at the side close to the fixture and the recording medium can be suppressed more efficiently.

Preferably, a distance between the opposing surface and the recording medium held on the holding part is 0.5 mm or more and 2 mm or less.

By setting the distance between the opposing surface and the recording medium to be 0.5 mm or more and 2 mm or less, deviation of the ink droplet caused by factors other than the airflow can be suppressed. Although setting the distance in this manner tends to cause occurrence of a particularly strong airflow between the opposing surface and the recording medium, the occurrence of such an airflow can also be suppressed.

Preferably, the central bypass passage is made up of a plurality of through holes formed in the housing.

This can suppress a deterioration in the rigidity of the housing, as compared with providing a single large through hole.

Preferably, the plurality of through holes are arranged between the upstream ejection port and the downstream ejection port, in a staggered pattern with respect to a second direction perpendicular to the first direction.

This enables the plurality of through holes to be densely arranged in the second direction while ensuring a large distance between adjacent ones of the through holes to thereby suppress a deterioration in the rigidity of the housing.

Preferably, the ejection part further includes a lateral bypass passage opened at at least one of both lateral sides of the upstream ejection port and both lateral sides of the downstream ejection port.

This can suppress an airflow flowing laterally from a space between the recording medium and the upstream or downstream ejection port. Therefore, deviation of the ink droplet in the vicinity of both lateral sides of the recording medium can be suppressed.

Therefore, an object of the present invention is to provide an image recording apparatus capable of suppressing an airflow occurring between the ejection part and the recording medium to thereby suppress deviation of the ink droplet in the vicinity of an end portion of the recording medium.

These and other objects, features, aspects and advantages of the present invention will become more apparent from the following detailed description of the present invention when taken in conjunction with the accompanying drawings.

DESCRIPTION OF THE PREFERRED EMBODIMENTS

Hereinafter, a preferred embodiment of the present invention will be described with reference to the accompanying drawings. In the following, a direction in which a paper sheet 9 is conveyed will be referred to as "conveyance direction", and a horizontal direction perpendicular to the conveyance direction will be referred to as "widthwise direction". The conveyance direction and the widthwise direction of this preferred embodiment correspond to a first direction and a second direction of the present invention, respectively.

<1. Configuration of Image Recording Apparatus>

Figure 1:
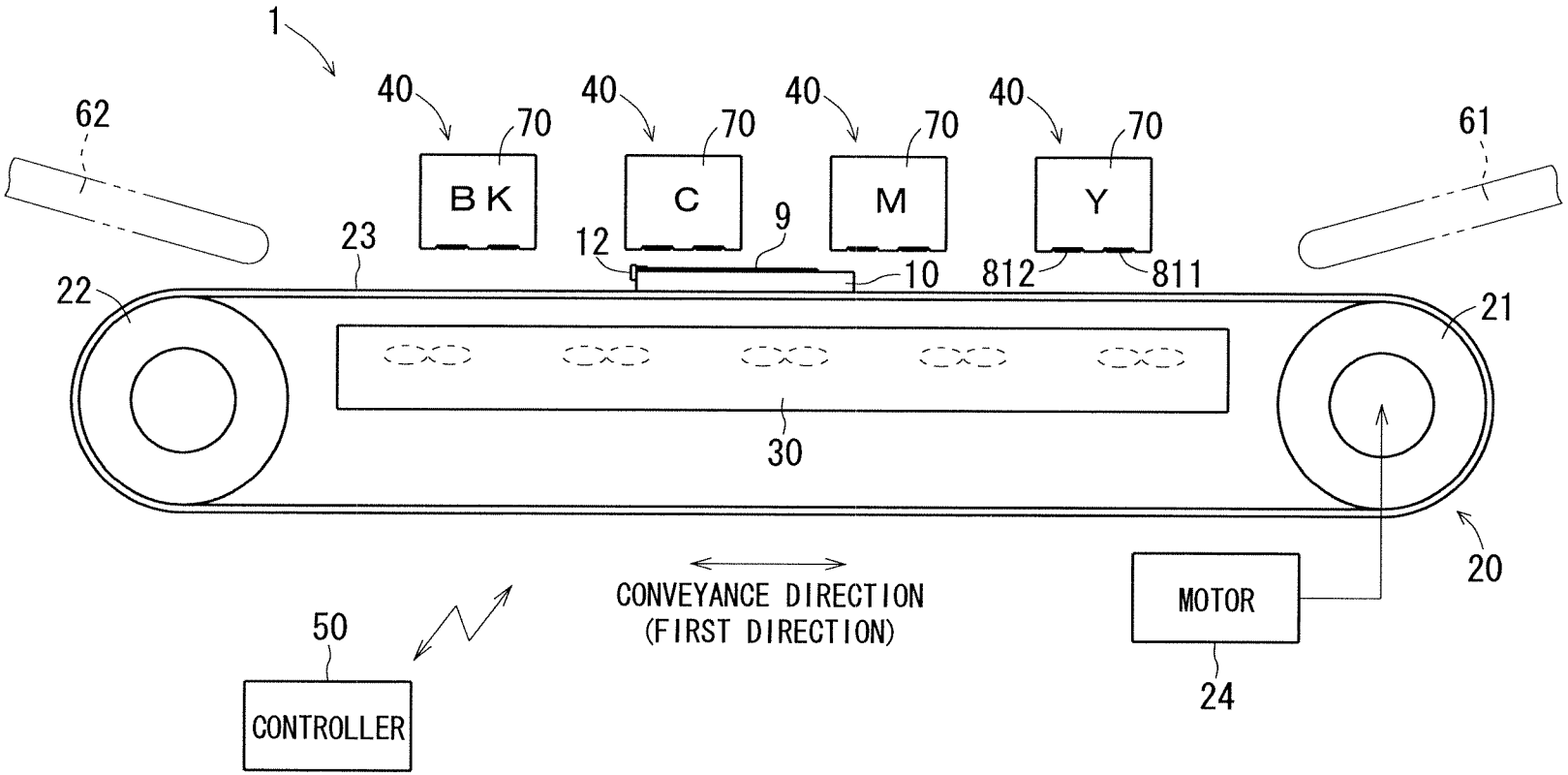
FIG. 1 is a schematic diagram of an image recording apparatus.

FIG. 1 is a schematic diagram of an image recording apparatus 1 according to one preferred embodiment of the present invention. The image recording apparatus 1 is an apparatus for ink-jet recording a color image on the paper sheet 9 that is a sheet-shaped recording medium. As shown in FIG. 1, the image recording apparatus 1 includes a holding plate 10, a moving mechanism 20, a fan unit 30, four head units 40, and a controller 50.

Figure 2:
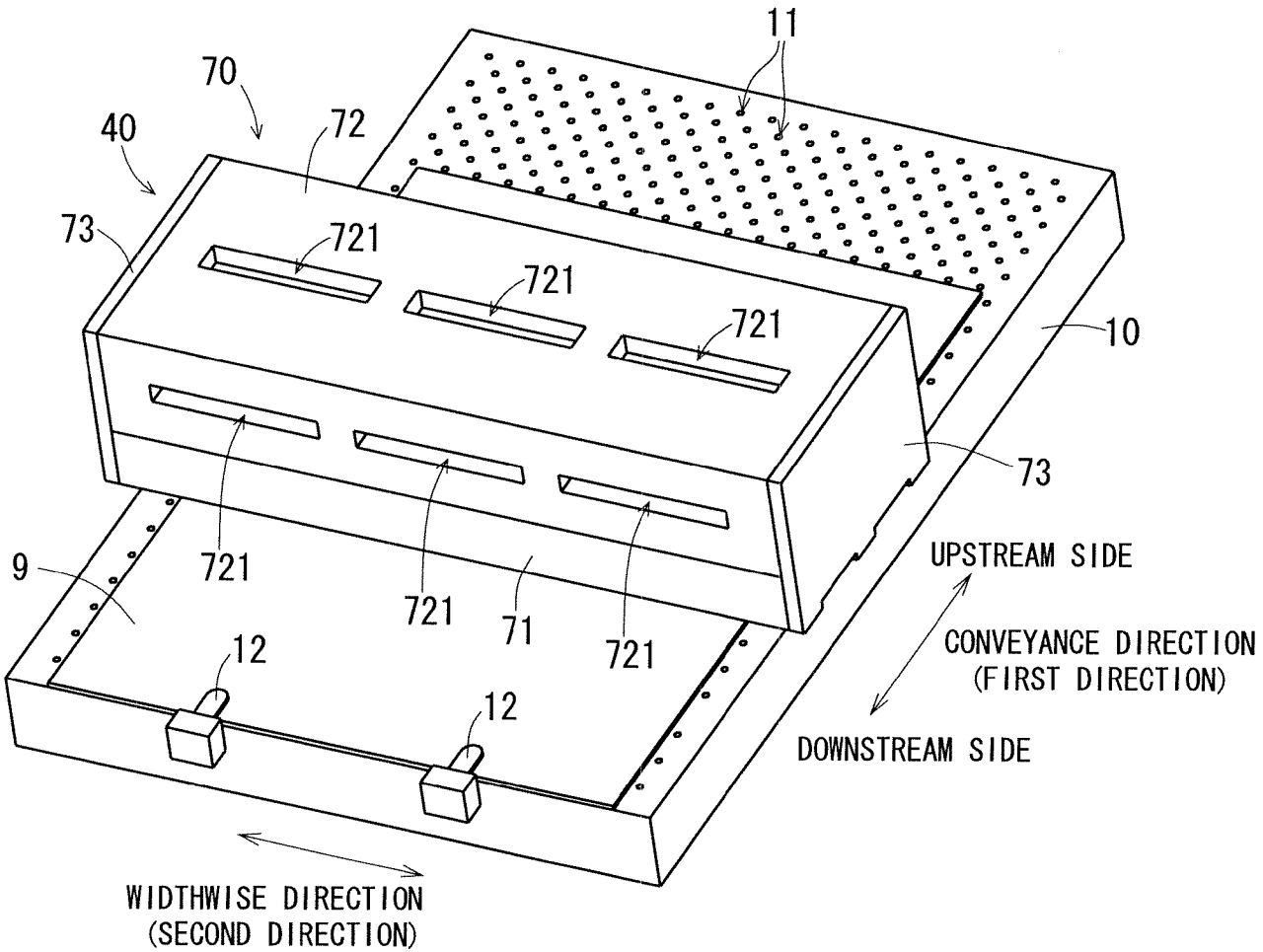
FIG. 2 is a perspective view of a holding plate and one head unit.

The holding plate 10 is a holding part having a flat-plate shape for sucking and holding the paper sheet 9 to an upper surface (holding surface) thereof FIG. 2 is a perspective view of the holding plate 10 and one head unit 40. A plurality of suction holes 11 are formed in the holding plate 10 so that the paper sheet 9 is sucked by negative pressure. Each of the suction holes 11 extends through the holding plate 10 in the vertical direction. On the upper surface of the holding plate 10, upper openings of the plurality of suction holes 11 are formed uniformly in a range wider than the paper sheet 9 to be processed. Thus, the holding plate 10 can deal with a plurality of kinds of paper sheets having different sizes.

A pair of fixtures 12 for fixing a front end portion of the paper sheet 9 is provided at an downstream end portion of the holding plate 10. Before an image is recorded, the paper sheet 9 is fed from a paper sheet feed unit 61 illustrated with an alternate long and two short dashes line in FIG. 1, and placed on the upper surface of the holding plate 10, with the front end portion thereof being pressed and fixed by the pair of fixtures 12. At this time, the fan unit 30 which will be described later causes a downward airflow or negative pressure in the plurality of suction holes 11. Therefore, the paper sheet 9 is sucked to the upper surface of the holding plate 10. After an image is recorded, the sucking by the suction holes 11 and the pressing by the fixtures 12 are removed, and the paper sheet 9 is discharged to a paper sheet discharge unit 62 illustrated with an alternate long and two short dashes line in FIG. 1.

The moving mechanism 20 is a moving part for conveying the holding plate 10 in the conveyance direction. As shown in FIG. 1, the moving mechanism 20 includes a drive sprocket 21 and a slave sprocket 22, and a loop chain 23 wound on the sprockets 21 and 22 to be stretched therebetween. The holding plate 10 is mounted to a part of the chain 23 such that lower openings of the suction holes 11 are not closed.

As conceptually shown in FIG. 1, a motor 24 serving as a power source is coupled to the drive sprocket 21. When the motor 24 is driven, the drive sprocket 21 is rotated to accordingly cause the chain 23 and the holding plate 10 to turn. The holding plate 10 is conveyed below the four head units 40 along the conveyance direction from the upstream side to the downstream side.

The fan unit 30 is arranged between the pair of sprockets 21 and 22. The fan unit 30 is structured with, for example, a plurality of blowers arranged along the conveying path. When the fan unit 30 operates, a downward airflow occurs in the conveying path of the holding plate 10. When the holding plate 10 having the paper sheet 9 placed thereon passes above the fan unit 30, the airflow of the fan unit 30 causes negative pressure in the plurality of suction holes 11. Due to the negative pressure, the paper sheet 9 is sucked to and held on the upper surface of the holding plate 10.

The four head units 40 are arranged at intervals in the conveyance direction above the conveying path of the paper sheet 9. The four head units 40 serve as an ejection part for ejecting ink droplets of yellow (Y), magenta (M), cyan (C), and black (BK), respectively, to the upper surface of the paper sheet 9. Since the structures of the four head units 40 are substantially equivalent to one another, the structure of one of the head units 40 will be described below.

Figure 3:
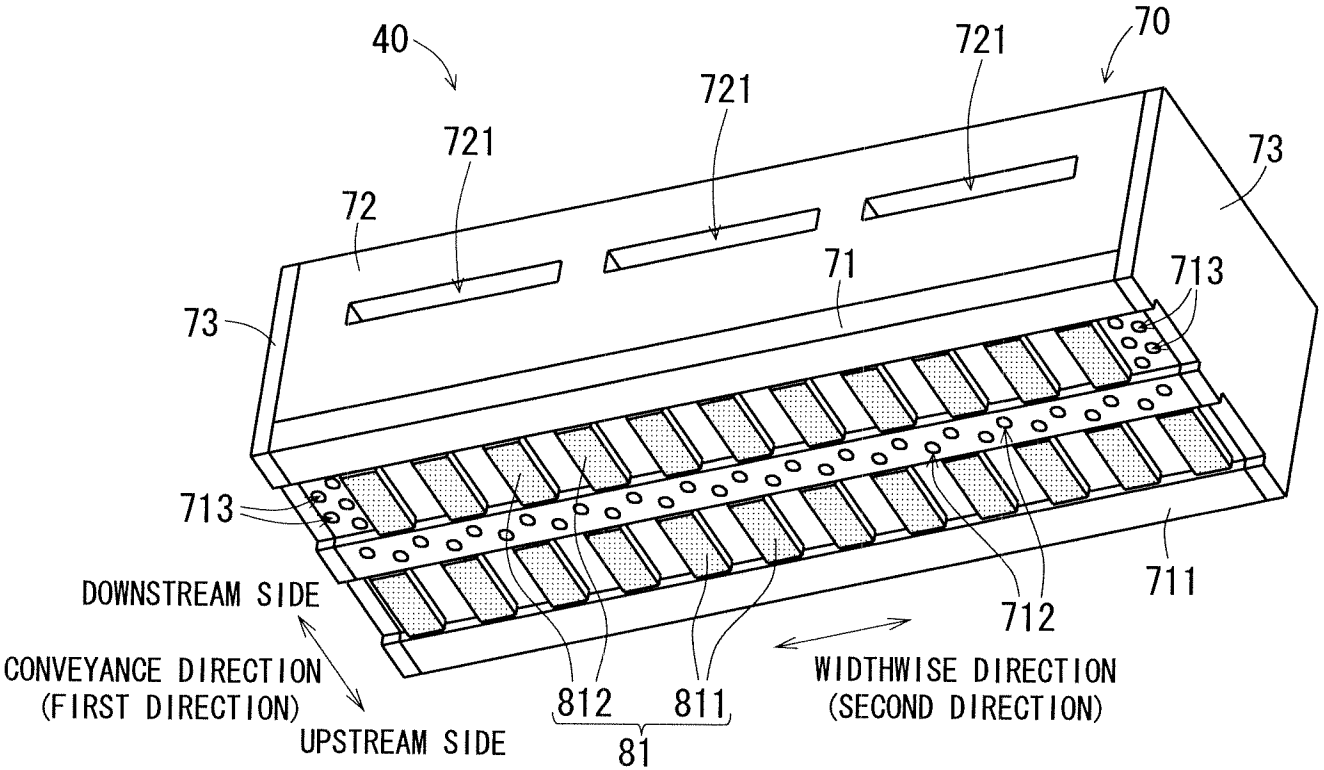
FIG. 3 is a perspective view of one head unit as seen from the lower surface side thereof.
Figure 4:
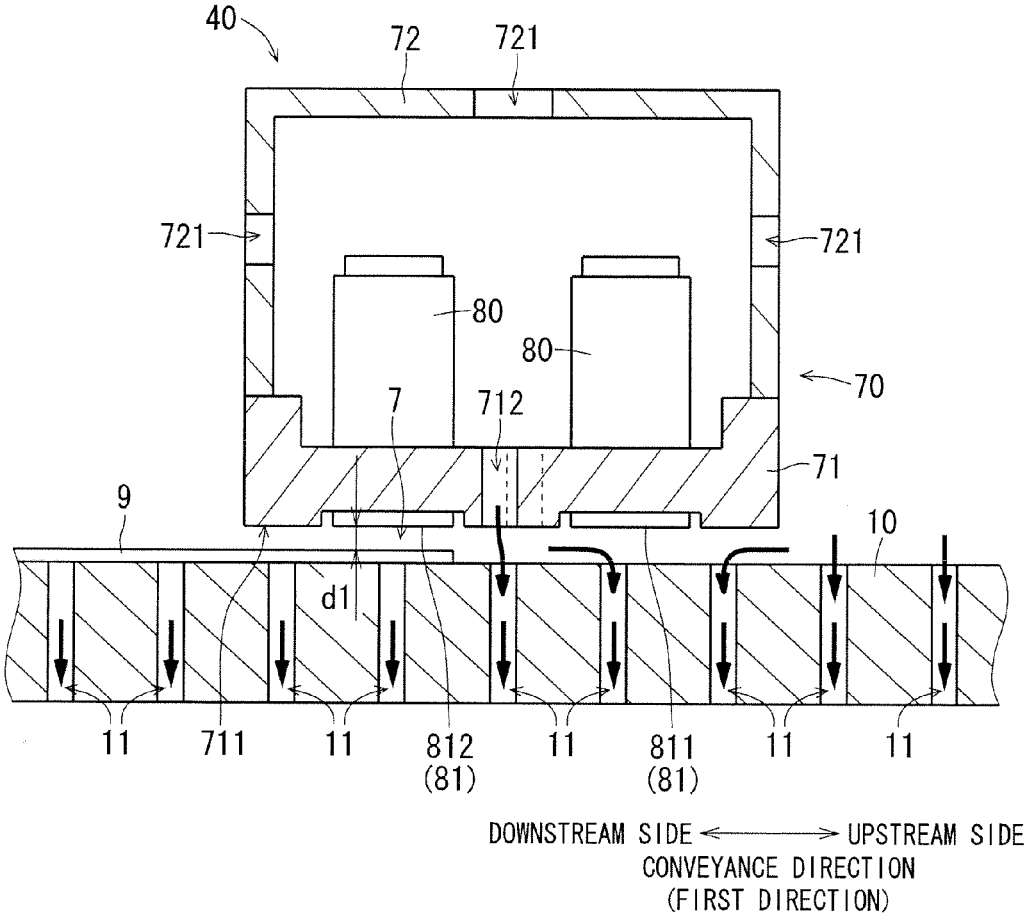
FIG. 4 is a vertical cross-sectional view of one head unit and the vicinity thereof as cut along a plane perpendicular to a widthwise direction.

FIG. 3 is a perspective view of one head unit 40 as seen from the lower surface side thereof FIG. 4 is a vertical cross-sectional view of one head unit 40 and the vicinity thereof as cut along a plane perpendicular to the widthwise direction. As shown in FIGS. 3 and 4, the head unit 40 includes a housing 70 and a plurality of ink-jet heads 80 fixed to the housing 70.

The housing 70 having a bottom member 71, a lid member 72, and a pair of side members 73 is, as a whole, configured as a substantially rectangular parallelepiped, hollow shape extending in the widthwise direction. A lower surface 711 of the bottom member 71 is an opposing surface opposed to the upper surface of the holding plate 10. A plurality of window portions 721 are provided in side surfaces and an upper surface of the lid member 72. Therefore, the interior of the housing 70 is a space open to the outside. Other members such as electrical wiring and a fan may be arranged inside the housing 70.

The plurality of ink-jet heads 80 are fixed to the bottom member 71. Each of the ink-jet heads 80 has, at a lower portion thereof, ejection ports 81 for ejecting ink droplets to the paper sheet 9 on the holding plate 10. As shown in FIG. 3, the plurality of ejection ports 81 are arranged in two rows on the lower surface 711 of the housing 70. More specifically, a row of a plurality of upstream ejection ports 811 and a row of a plurality of downstream ejection ports 812 are arranged at an interval in the conveyance direction.

In this preferred embodiment, with respect to the widthwise direction, the downstream ejection port 812 is arranged at a position corresponding to an intermediate position between adjacent ones of the upstream ejection ports 811. That is, with respect to the widthwise direction, the downstream ejection port 812 is arranged between the upstream ejection ports 811. By the plurality of upstream ejection ports 811 and the plurality of downstream ejection ports 812, an image is recorded over an entire region in the widthwise direction of the paper sheet 9. In this manner, the plurality of ejection ports 81 are arranged in a staggered pattern (obliquely and alternately), and thereby the plurality of ejection ports 81 can be arranged with a high density with respect to the widthwise direction.

Additionally, a plurality of through holes 712 are formed in the bottom member 71 of the housing 70. The plurality of through holes 712 extend through the bottom member 71 in the vertical direction in a region between the row of the upstream ejection ports 811 and the row of the downstream ejection ports 812. Thus, on the lower surface 711 of the bottom member 71, lower end portions of the through holes 712 are opened between the upstream ejection ports 811 and the downstream ejection ports 812.

As shown in FIG. 4, when a rear end portion and therearound of the paper sheet 9 is opposed to the downstream ejection ports 812, the suction holes 11 exposed at the upstream side of the paper sheet 9 are located under the housing 70. Therefore, an airflow sucked to these suction holes 11 occurs in the gap between the housing 70 and the holding plate 10. In this preferred embodiment, gas sucked to the suction holes 11 can be absorbed from the through holes 712. As a result, occurrence of the airflow flowing toward the upstream side is suppressed in a space 7 (hereinafter referred to as "above-paper gap space 7") that is formed between the paper sheet 9 and a part of the lower surface of the housing 70 at the downstream side of the through hole 712. Suppression of occurrence of the airflow in the above-paper gap space 7 leads to suppression of deviation of ink droplets ejected from the downstream ejection ports 812. This consequently suppresses occurrence of a defect such as unevenness in recording in the vicinity of the rear end portion of the paper sheet 9.

In this preferred embodiment, the sizes of the respective parts are set such that a total opening area of the plurality of through holes 712 can be larger than an opening area of the above-paper gap space 7 (a cross-sectional area of the above-paper gap space 7 perpendicular to the conveyance direction). Accordingly, a passage resistance of the whole of the plurality of through holes 712 is set lower than a passage resistance of the above-paper gap space 7. In this structure, absorption of gas from the plurality of through holes 712 is more facilitated as compared with absorption of gas from the above-paper gap space 7. Therefore, occurrence of the airflow in the above-paper gap space 7 can be further suppressed.

As shown in FIG. 4, the through hole 712 of this preferred embodiment communicates with the outside space via an interior space of the housing 70 and the window portions 721 of the lid member 72. Therefore, it is more preferable that a total passage resistance including passage resistances of these spaces is lower than the passage resistance of the above-paper gap space 7. However, in a case where the interior space and the window portions 721 of the housing 70 are sufficiently larger than the through holes 712, the passage resistances of the interior space and the window portions 721 of the housing 70 are negligible in terms of the absorption of gas from the through holes 712. In such a case, as described above, it suffices that the passage resistance of the through holes 712 is lower than the passage resistance of the above-paper gap space 7.

Deviation of ink droplets ejected from the ink-jet heads 80 is caused not only by the airflow in the above-paper gap space 7 but also various factors. As a distance d1 of the above-paper gap space 7 is larger, deviation of ink droplets caused by the factors (such as inclination and clogging of the ejection port) other than the airflow increases. In this respect, it is preferable that the distance dl of the above-paper gap space 7 is small. For example, it is preferable that the distance dl of the above-paper gap space 7 is set to be 0.5 mm or more and 2 mm or less.

Setting the distance d1 in this manner tends to cause occurrence of a strong airflow in the above-paper gap space 7. However, in the image recording apparatus 1, the occurrence of the airflow in the above-paper gap space 7 can be suppressed by absorption of gas from the through holes 712. Thus, the occurrence of the airflow in the above-paper gap space 7 can be suppressed, while the deviation of ink droplets caused by the factors other than the airflow can be suppressed.

The head unit 40 of this preferred embodiment is structured with the plurality of ink-jet heads 80 fixed to the lower surface of the housing 70. Thereby, the plurality of ink-jet heads 80 are accurately arranged, to structurally prevent positional misalignment among the ink-jet heads 80. Such a structure in which the lower surface of the housing 70 is opposed to the upper surface of the holding plate 10 tends to cause occurrence of, particularly, an airflow in the above-paper gap space 7. However, in the image recording apparatus 1, the occurrence of the airflow in the above-paper gap space 7 can be suppressed by absorption of gas from the through holes 712. Thus, in the structure of this preferred embodiment, the plurality of ink-jet heads 80 can be accurately arranged, while the occurrence of the airflow in the above-paper gap space 7 can be suppressed.

In this preferred embodiment, the plurality of through holes 712 form a central bypass passage for suppressing the airflow in the above-paper gap space 7. This can suppress deterioration in the rigidity of the housing 70 as compared with providing a single large through hole in the bottom member 71 of the housing 70, while ensuring the opening area of the central bypass passage as a whole.

Particularly, in this preferred embodiment, as shown in FIG. 3, the plurality of through holes 712 are arranged in a staggered pattern (obliquely and alternately) with respect to the widthwise direction. This enables the plurality of through holes 712 to be densely arranged in the widthwise direction while ensuring a large distance between adjacent ones of the through holes 712, as compared with the plurality of through holes 712 being linearly arranged. As a result, a deterioration in the rigidity of the housing 70 can be further suppressed.

As shown in FIG. 3, in this preferred embodiment, the plurality of through holes 713 are provided at both lateral sides of the downstream ejection ports 812. The plurality of through holes 713 extend through the bottom member 71 of the housing 70 in the vertical direction. These through holes 713 form a lateral bypass passage for suppressing an airflow flowing laterally from the above-paper gap space 7. That is, gas sucked to the suction holes 11 exposed at both side of the paper sheet 9 is absorbed from these through holes 713. This suppresses the airflow flowing laterally from the above-paper gap space 7. As a result, deviation of ink droplets in the vicinity of both sides of the paper sheet 9 can also be suppressed.

As shown in FIG. 1, the image recording apparatus 1 includes the controller 50. The controller 50 is configured by a computer having a CPU and a memory. The controller 50 is electrically connected to the motor 24, the fan unit 30, the plurality of ink-jet heads 80, and the like, within the apparatus. The controller 50 electrically controls operations these parts in accordance with a program and data that are preset. In this manner, the image recording apparatus 1 proceeds with an image recording process on the paper sheet 9.

<2. Example>

Figure 5:
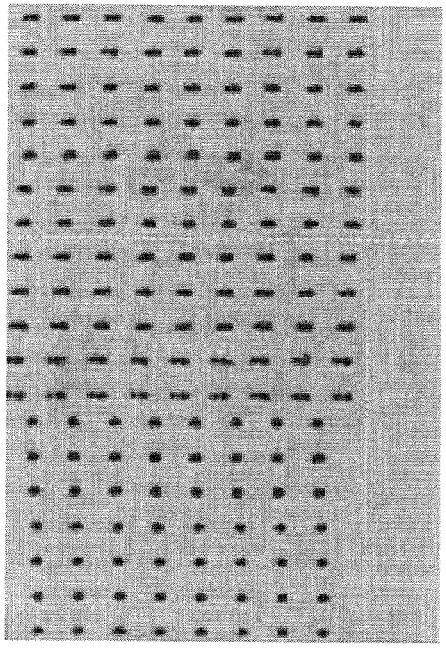
FIG. 5 is a photograph of a paper sheet on which a plurality of dots are recorded in a grid pattern using a head unit having no through hole formed between upstream ejection ports and downstream ejection ports.
Figure 6:
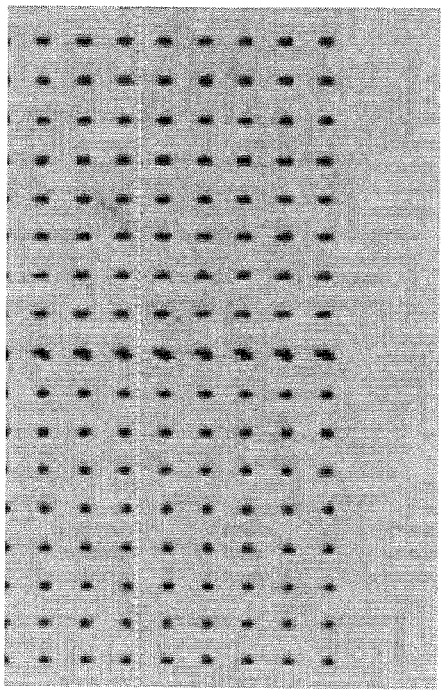
FIG. 6 is a photograph of a paper sheet on which a plurality of dots are recorded in a grid pattern using a head unit having through holes formed between upstream ejection ports and downstream ejection ports.

FIG. 5 is a photograph of a paper sheet on which a plurality of dots are recorded in a grid pattern using a head unit having no through hole formed between upstream ejection ports and downstream ejection ports. FIG. 6 is a photograph of a paper sheet on which a plurality of dots are recorded in a grid pattern using a head unit having through holes formed between upstream ejection ports and downstream ejection ports. In examples shown in FIGS. 5 and 6, image recording was performed under the same conditions except the condition of whether or not the through holes are provided.

Each of FIGS. 5 and 6 shows the rear end portion and therearound of the paper sheet. In FIGS. 5 and 6, the dots recorded in the vicinity of a lower side are dots recorded by ink droplets ejected from the upstream ejection ports. In FIGS. 5 and 6, the dots recorded in the vicinity of an upper side are dots recorded by ink droplets ejected from the downstream ejection ports. Thus, in these examples, the head unit was controlled such that only the upstream ejection ports were used to record the dots in an area near the lower side while only the downstream ejection ports were used to record the dots in an area near the upper side. On inputted image data, the dots handled by the upstream ejection ports and the dots handled by the downstream ejection ports are arranged at the same position with respect to the conveyance direction.

Comparing FIGS. 5 and 6, it is found that in the example of FIG. 5, the dots recorded by the ink droplets ejected from the downstream ejection ports are deviated to the upstream side, and additionally, in the example of FIG. 5, the dots recorded by the ink droplets ejected from the downstream ejection ports are deformed so as to stretch in the conveyance direction. It can be considered that these deviation and deformation were caused by an airflow obliquely flying ink droplets ejected from the downstream ejection. On the other hand, in the example of FIG. 6, the deviation and deformation are suppressed. From these results, it can be seen that providing the through holes in the head unit suppressed the deviation and deformation of ink droplets.

<3. Modification>

While one preferred embodiment of the present invention has been described above, the present invention is not limited to the preferred embodiment described above.

In the preferred embodiment described above, the plurality of through holes 712 are arranged in a staggered pattern with respect to the widthwise direction. However, the plurality of through holes 712 may be arranged in a straight line. The shape of the opening of each through hole 712 may be any shape (such as an oval shape and a rectangular shape) other than a circular shape. Moreover, the central bypass passage of the present invention may be formed as a single through hole.

In the preferred embodiment described above, the pair of fixtures 12 are provided at the downstream end portion of the holding plate 10. However, the fixtures 12 may be provided at an upstream end portion of the holding plate 10. In this case, the paper sheet 9 is placed such that the upstream end portion of the holding plate 10 can be coincident with the rear end portion of the paper sheet 9. Therefore, as shown in FIG. 7, when the front end portion and therearound of the paper sheet 9 is opposed to the upstream ejection port 811, an airflow sucked to the suction holes 11 occurs below the housing 70 at the downstream side of the paper sheet 9.

In this case as well, by providing the plurality of through holes 712 between the upstream ejection ports 811 and the downstream ejection ports 812, gas sucked to the suction holes 11 can be absorbed from the plurality of through holes 712. As a result, occurrence of an airflow flowing toward the downstream side is suppressed in a space 8 that is formed between the paper sheet 9 and a part of the lower surface of the housing 70 at the upstream side of the through holes 712. This consequently suppresses deviation of ink droplets ejected from the upstream ejection ports 811.

Figure 7:
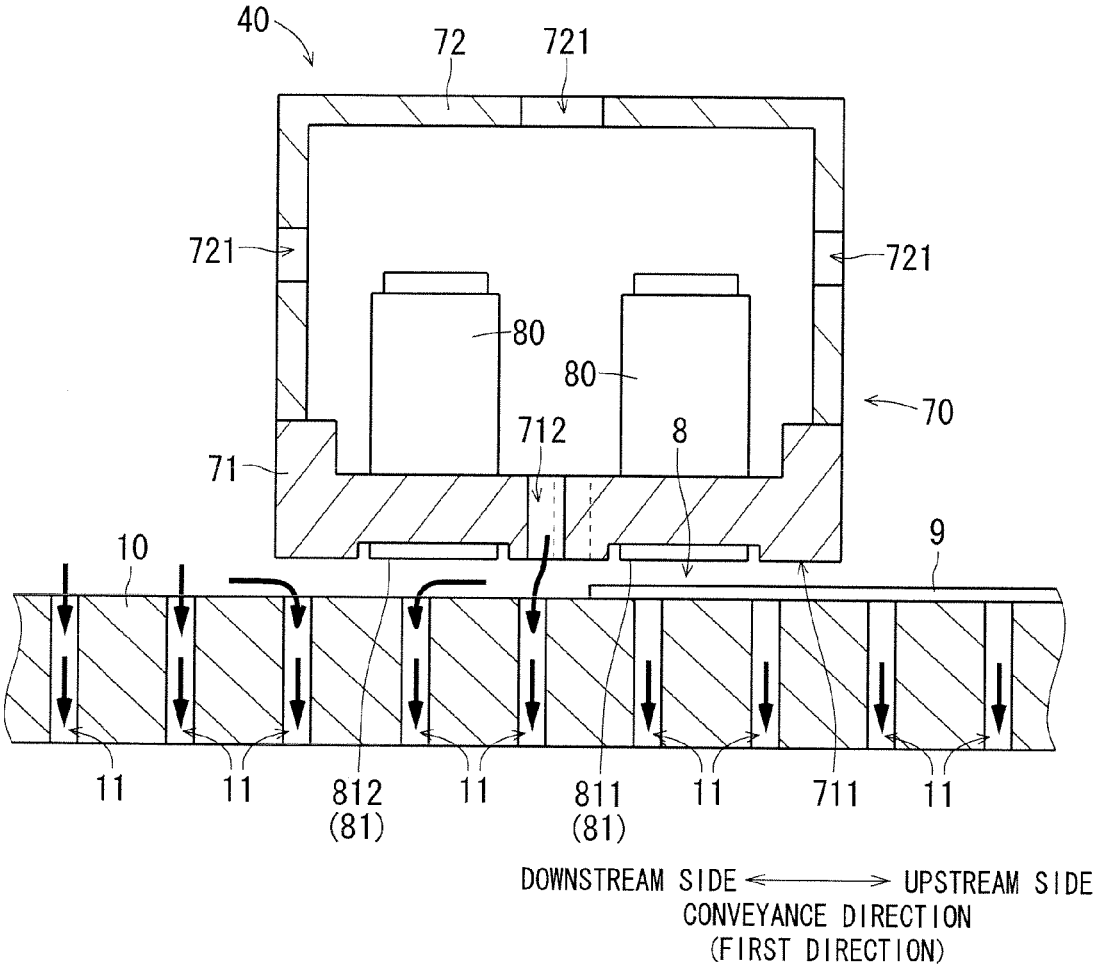
FIG. 7 is a vertical cross-sectional view of one head unit and the vicinity thereof as cut along a plane perpendicular to a widthwise direction.

In the example of FIG. 7, similarly to the preferred embodiment described above, it is preferable that the sizes of the respective parts are set such that a total opening area of the plurality of through holes 712 can be larger than an opening area of the space 8 (a cross-sectional area of the space 8 perpendicular to the conveyance direction) formed between the paper sheet 9 and the part of the lower surface of the housing 70 at the upstream side of the through holes 712. It is also preferable that a total passage resistance of the plurality of through holes 712 is set lower than a passage resistance of the space 8.

In the preferred embodiment described above, the plurality of through holes 712 are positioned substantially at the center of a region between the upstream ejection ports 811 and the downstream ejection ports 812. However, the plurality of through holes 712 may be positioned slightly closer to the fixture 12 side relative to the center of the region between the upstream ejection ports 811 and the downstream ejection ports 812. This reduces the distance between the through holes 712 and the ejection ports 81 at the fixture side (the downstream ejection ports 812 in the example of FIG. 4, and the upstream ejection ports 811 in the example of FIG. 7). As a result, an airflow occurring between the paper sheet 9 and the ejection ports 81 at the fixture side can be suppressed more efficiently.

In the preferred embodiment described above, the through holes 713 serving as the lateral bypass passage are provided only at both lateral sides of the downstream ejection ports 812. However, the through holes 713 serving as the lateral bypass passage may be provided at both lateral sides of the upstream ejection ports 811. Alternatively, the through holes 713 serving as the lateral bypass passage may be provided at both lateral sides of the upstream ejection ports 811 and also at both lateral sides of the downstream ejection ports 812.

In the preferred embodiment described above, the plurality of suction holes 11 extend through the holding plate 10 in the vertical direction. However, the suction hole 11 may be curved inside the holding plate 10. Moreover, a plurality of suction holes 11 may be in communication with one another within the holding plate 10.

In the preferred embodiment described above, a mechanism including the pair of sprockets 21 and 22, the chain 23, and the motor 24 is adopted as a moving mechanism for conveying the holding plate 10. Here, other mechanisms for conveying a holding part may be adopted as a moving part of the present invention. For example, a mechanism including a ball screw and a nut or a mechanism including a linear motor may be used to convey the holding part.

In the preferred embodiment described above, the holding plate 10 and the paper sheet 9 are conveyed while being maintained in a horizontal attitude. Here, the holding plate 10 and the paper sheet 9 may be conveyed while being inclined with respect to a horizontal plane.

In the preferred embodiment described above, the holding plate 10 and the paper sheet 9 are moved relative to the head unit 40 that remains stationary. Here, the head unit 40 may be moved in the conveyance direction relative to the holding plate 10 and the paper sheet 9 that remain stationary. That is, it suffices that the holding plate 10 and the paper sheet 9, and the head unit 40 are moved in the conveyance direction relative to each other.

The above-described image recording apparatus 1 records an image on the paper sheet 9 serving as a recording medium. Here, the image recording apparatus of the present invention may record an image on a sheet-shaped recording medium (such as a film made of a resin) other than a general paper.

The above-described image recording apparatus 1 is an apparatus for recording a color image by the four head units 40. Here, the number of head units 40 may be one to three, or may be five or more. Moreover, the image recording apparatus of the present invention may be an apparatus for recording a single color image.

The elements shown in the preferred embodiment and the modification described above may be appropriately combined as long as no inconsistency arises.

While the invention has been shown and described in detail, the foregoing description is in all aspects illustrative and not restrictive. It is therefore understood that numerous modifications and variations can be devised without departing from the scope of the invention.

What is claimed is:

1. An image recording apparatus comprising:

a holding part having a holding surface for sucking and holding a sheet-shaped recording medium by negative pressure;

an ejection part for ejecting an ink droplet to the recording medium held on said holding surface; and a moving part for moving said holding part relative to said ejection part, in a first direction extending along said holding surface;

said ejection part including:

a housing having an opposing surface opposed to said holding surface;

an upstream ejection port and a downstream ejection port provided on said opposing surface and arranged at an interval in said first direction; and a central bypass passage opened in a region of said opposing surface of said housing between said upstream ejection port and said downstream ejection port, wherein a distance between said opposing surface and the recording medium held on said holding part is 0.5 mm or more and 2 mm or less.

2. The image recording apparatus according to claim 1, wherein said ejection part further includes a lateral bypass passage opened at at least one of both lateral sides of said upstream ejection port and both lateral sides of said downstream ejection port.

3. The image recording apparatus according to claim 1, wherein said ejection part comprises a plurality of ejection parts each for ejecting an ink droplet of a different color, and each ejection part of said plurality of ejection parts includes said upstream ejection port for ejecting an ink droplet and said downstream ejection port for ejecting an ink droplet of the same color as the ink droplet ejected from said upstream ejection port.

4. An image recording apparatus comprising:

a holding part having a holding surface for sucking and holding a sheet-shaped recording medium by negative pressure;

an ejection part for ejecting an ink droplet to the recording medium held on said holding surface; and a moving part for moving said holding part relative to said ejection part, in a first direction extending along said holding surface;

said ejection part including:

a housing having an opposing surface opposed to said holding surface;

an upstream ejection port and a downstream ejection port provided on said opposing surface and arranged at an interval in said first direction; and a central bypass passage opened in a region of said opposing surface of said housing between said upstream ejection port and said downstream ejection port, wherein said central bypass passage is made up of a plurality of through holes formed in said housing.

5. The image recording apparatus according to claim 4, wherein said plurality of through holes are arranged between said upstream ejection port and said downstream ejection port, in a staggered pattern with respect to a second direction perpendicular to said first direction.

6. The image recording apparatus according to claim 4, wherein said ejection part further includes a lateral bypass passage opened at at least one of both lateral sides of said upstream ejection port and both lateral sides of said downstream ejection port.

7. The image recording apparatus according to claim 4, wherein said ejection part comprises a plurality of ejection parts each for ejecting an ink droplet of a different color, and each ejection part of said plurality of ejection parts includes said upstream ejection port for ejecting an ink droplet and said downstream ejection port for ejecting an ink droplet of the same color as the ink droplet ejected from said upstream ejection port.

8. An image recording apparatus comprising:

a holding part having a holding surface for sucking and holding a sheet-shaped recording medium by negative pressure;

an ejection part for ejecting an ink droplet to the recording medium held on said holding surface; and a moving part for moving said holding part relative to said ejection part, in a first direction extending along said holding surface;

said ejection part including:

a housing having an opposing surface opposed to said holding surface, an upstream ejection port and a downstream ejection port provided on said opposing surface and arranged at an interval in said first direction; and a central bypass passage opened in a region of said opposing surface of said housing between said upstream ejection port and said downstream ejection port, wherein said holding part includes a fixture for fixing one end portion of the recording medium to one end portion of said holding part with respect to said first direction, said ejection part comprises a plurality of ejection parts each for ejecting an ink droplet of a different color, and each ejection part of said plurality of ejection parts includes said upstream ejection port for ejecting an ink droplet and said downstream ejection port for ejecting an ink droplet of the same color as the ink droplet ejected from said upstream ejection port.

* * * * *